United States Patent [19]

Boscoe et al.

[11] Patent Number: 4,673,923

[45] Date of Patent: Jun. 16, 1987

[54] ARTICLE SURVEILLANCE USING REACTIVATABLE RESONANT TAGS

[75] Inventors: John J. Boscoe, Glen Mills, Pa.; Peter L. Gill, Long Valley, N.J.

[73] Assignee: Checkpoint Systems, Inc., Thorofare, N.J.

[21] Appl. No.: 864,252

[22] Filed: May 19, 1986

[51] Int. Cl.[4] ..... G08B 13/26

[52] U.S. Cl. ..... 340/572; 343/894

[58] Field of Search ..... 340/572; 343/894, 895; 342/27

[56] References Cited

U.S. PATENT DOCUMENTS 3,500,373 3/1970 Minasy ..... 340/572
3,810,147 5/1974 Lichtblau ..... 340/572
4,074,249 2/1978 Minasy ..... 340/572
4,075,618 2/1978 Montean ..... 340/572

*Primary Examiner*—Glen R. Swann, III
*Attorney, Agent, or Firm*—Alfred Stapler

[57] ABSTRACT

A resonant circuit-bearing tag, which is capable of causing an article protection system to give an alarm, is provided with a release liner surface. To permit removal of an article to which the tag is attached without causing an alarm, a metal foil-bearing label is adhered to the release liner surface of the tag. By virtue of the release liner on the tag, the label is susceptible of being peeled off the tag, thereby restoring the tag's ability to cause an alarm.

9 Claims, 4 Drawing Figures

ARTICLE SURVEILLANCE USING REACTIVATABLE RESONANT TAGS

BACKGROUND OF THE INVENTION

This invention relates to apparatus for protecting articles against unauthorized removal.

More particularly, it relates to apparatus which is used to electronically detect articles which are being removed from a store or other protected premises. A particular application of such apparatus is in the detection of shoplifting.

In one known form, such apparatus includes means for generating, in the exit path from the protected premises, a radio-frequency field which is periodically swept through a predetermined frequency range. Attached to the protected articles are tags bearing inductance-capacitance circuits which are resonant within the swept-frequency range. When an article with such a tag attached is carried out through the exit (and therefore through the radio-frequency field), it disturbs that field in a manner which can be sensed by a detector. This detector provides an output which can be used to operate an indicator, e.g. an alarm such as a buzzer or a light.

Apparatus of this type is disclosed, for exampled, in U.S. Pat. No. 3,810,147, issued May 7, 1974, the contents of which are incorporated herein by reference as though fully set forth herein.

In order to distinguish between articles whose removal is authorized (e.g. by having been paid for prior to store exiting) and those whose removal is not authorized (because they are being shoplifted), it is known to apply to the tags on the former a separate adhesive label which incorporates a layer of electrically conductive material such as metal foil. Such a label has the effect of disabling the capability of the resonant circuit to disturb the electric field. Therefore, an article which carries both the resonant circuit-bearing tag and the superposed adhesive label will not cause an alarm, whereas one which has not been provided with such a label will cause an alarm.

In practice, when dealing with shoplifting prevention, the foil-bearing label will typically be applied by the store clerk who performs the check-out operation, at the time when payment is made for the article which is to be carried out of the store.

A problem which has sometimes arisen in connection with apparatus of the type described above is that the application of the foil-bearing label does not always provide a totally reliable way to prevent the resonant circuit-bearing tag from causing an alarm. The reason is that such application is typically only one of several functions which have to be performed by the store clerk, who is often under the pressure of a large volume of customers and goods to be processed. Therefore, the application of such a label may not be carried out meticulously enough to cause permanent adhesion of the label to the tag. Impermanent adhesion would create the risk that the label would sooner or later fall off, or be stripped of by handling of the merchandise, whereupon the resonant circuit-bearing tag would become unintentionally capable of again causing an alarm.

Because of this, the striving has been to enhance the adhesion between the foil-bearing label and the circuit-bearing tag, so that even relatively careless application would nevertheless result in a combination of tag and label which are permanently adhered to each other.

While quite successful in achieving its intended purpose, this enhancement of adhesion permanence between label and tag also had some undesired side-effects. In particular, it reduced the flexibility of utilization of the overall article protection technique. It is not always the case that a resonant circuit-bearing tag, once made alarm-ineffective by application of a foil-bearing label, should remain permanently ineffective. For example, when the articles to be protected are video tape cassettes which are distributed through rental rather than sale, it is desired to have the protection go through cycles of effectiveness followed by ineffectiveness. While a cassette is in the store, before it has been checked out for rental, the circuit-bearing tag which is attached to it should be effective to cause an alarm if the cassette is carried out through the protected store exit. In contrast, when the cassette has been properly checked out, the tag should become ineffective, so that no alarm is given when the checked-out cassette leaves the store. This condition should continue to prevail until the cassette is carried back into the store and is formally checked back in. After that, however, the cassette's protection by an alarm-effective tag should be restored. This cycle then should be repeatable during successive rentals.

Use of the conventional foil-bearing label in this situation meant that each time a cassetts was returned, a new circuit-bearing tag had to be applied in order to reestablish the desired alarm effectiveness.

This was not only costly, but also created a problem in view of the limited space which is available on the cassette itself for the placement of such tags.

SUMMARY OF THE INVENTION

Accordingly, it is an object of the present invention to overcome this problem.

It is another object to provide an improved technique for protecting articles, such as video tape cassettes, with resonant circuit-bearing tags which are effective to cause an alarm when carried through a radio-frequency field which periodically sweeps through the resonant frequency of the tag.

It is still another object to provide such a technique for use in situations in which the protection has to be alternately made effective and ineffective in recurrent cycles.

It is still another object to provide such a technique which does not require the use of a new circuit-bearing tag each time the protection is to be restored to effectiveness.

These and other objects which will appear are achieved in accordance with the present invention by constructing the resonant circuit-bearing tag and the foil-bearing label in such manner that they can be readily and securely adhered to each other, but yet also be readily separated, without damage to the circuit-bearing tag and especially without damage to the resonant circuit which that tag bears.

BRIEF DESCRIPTION OF THE DRAWINGS

For further details, reference is made to the discussion which follows, in light of the accompanying drawings wherein.

DESCRIPTION OF THE PREFERRED EMBODIMENTS

Figure 1:
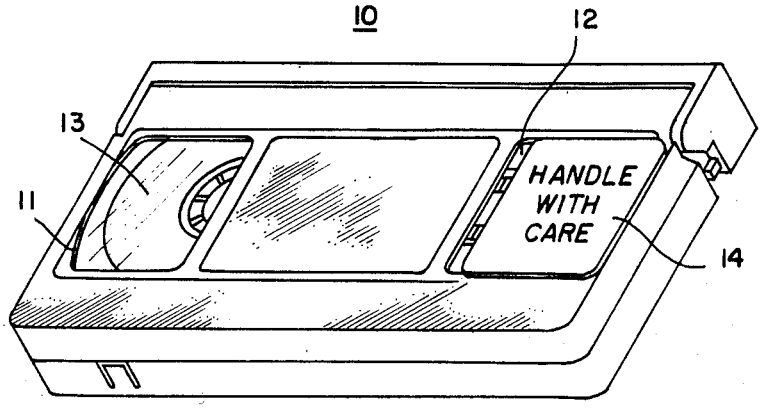
FIG. 1 shows an embodiment of one element of the invention, used in conjunction with a video tape cassette.

The same reference numerals designate similar elements in the several figures.

Referring to FIG. 1, this shows a typical video tape cassette 10, which is to be merchandised through rental, and which is to be protected by the type of apparatus that is the subject of the present invention.

As appears in FIG. 1, this cassette 10 has the conventional windows 11, 12, through which are visible the tape storage reels and the video tape 13 wound thereon. In FIG. 1, the tape 13 is shown in that state in which it is conventionally found while the cassette is in the rental store before being checked out, namely fully rewound. In accordance with the present invention, a tag 14 is attached by adhesive to the cassette 10.

In FIG. 1, this tag 14 is shown attached over window 12, but that location is not critical. Also in FIG. 1, this tag 14 is shown with a printed legend thereon. This, too, is optional, and so is the text of any such legend.

Figure 2:
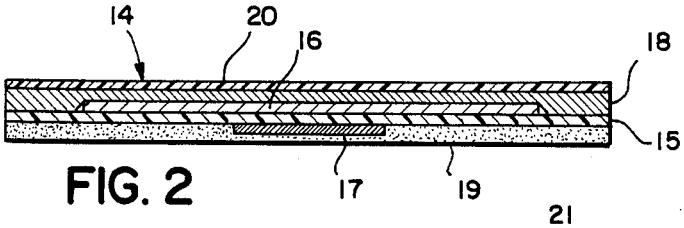
FIG. 2 is a diagrammatic illustration of the layered construction of the element of the invention shown in FIG. 1.

The construction of tag 14 may, with one exception, be of any form that is conventional in the field of article protection by means of resonant circuit-bearing tags. Essentially, the tag will be a multi-layer structure such as shown (diagrammatically and not to scale) in FIG. 2. This structure consists of a dielectric substrate 15, on which is foremd the resonant circuit. This circuit consists of patterns of metal 16 and 17, positioned on opposite sides of the substrate 15. These patterns form an inductor and a capacitor, with the substrate 15 providing their mechanical support and also the dielectric for the capacitor plates located on opposite sides of the substrate. For added strength and protection, a paper layer 18 is permanently adhered to one side of the previously described layers. A layer of adhesive material 19 is applied to the opposite side. This adhesive 19 is then used to permanently attach the tag 14 to the article to be protected, i.e. the cassette 10 (FIG. 1) in the present instance.

In accordance with the present invention, the paper layer 18 is further provided with a surface layer 20 of a material which is capable of cooperating with an adhesive to enable the adhesive to be separated from the surface layer. Such a material is conventionally referred to as a "release agent". The surface layer (layer 20 in FIG. 2) which is made of such material is referred to as a "release liner".

Figure 3:
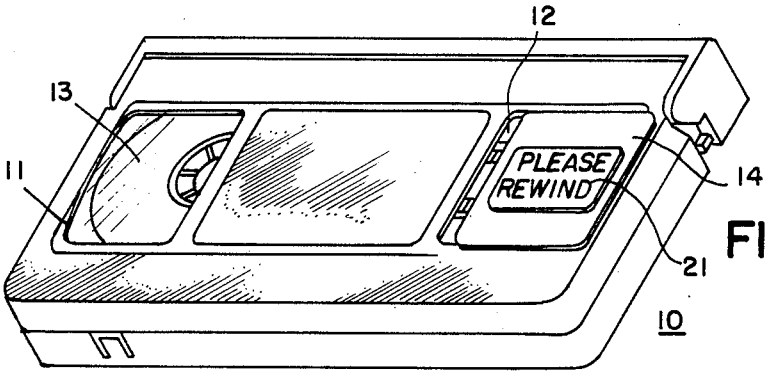
FIG. 3 shows an embodiment of the other element of the invention, also used in conjunction with a video tape cassette.

Referring now to FIG. 3, this shows the same cassette 10 as in FIG. 1, but after it has been checked out for rental. As can be seen, the tag 14 has now been overlaid with a label 21, which may again be printed with a message, if desired.

Figure 4:
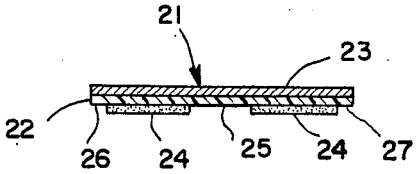
FIG. 4 is a diagrammatic illustration of the layered construction of the element of the invention shown in FIG. 2.

As shown in FIG. 4, this label 21 is also a multi-layer structure, consisting of a metal foil layer 22, laminated to a paper cover layer 23. On the opposite side of foil 22, there is a layer of pressure-sensitive adhesive 24. When applied to the cassette 10, the adhesive 24 is placed on top of the previously applied tag 14, in contact with the release liner 20 of that tag. With label 21 thus in place, the tag 14 becomes incapable of causing an alarm when the checked-out cassette 10 is carried out of the store, past the article protection system at its exit. Likewise, no alarm will occur when the cassette is carried back into the store, past the article protection system, in order to end the rental transaction. However, after the cassette has been checked back in, it suffices to peel label 21 off the tag 14 in order to reenable that tag to cause an alarm in response to attempted cassette removal from the store.

By providing release lining 20 on tag 14, repeated applications and removals of a label 21 become possible, without harming tag 14, and paraicularly without adverse effect on the resonant circuit born by that tag.

The release lining 10 may be provided in any known, conventional manner. For example, it may take the form of a release coating applied to paper layer 18, or it may take the form of a film of polypropylene laminated to layer 18.

In accordance with this invention, the combination of the release lining 20 of tag 14 and of the adhesive 24 of label 21 should be chosen so as to provide release values in the range of 15–60 grams per centimeter and preferably in the range of 20–40 grams per centimeter. These values are as determined by a Fast Release Tester available from Testing Machinery Inc. of Amityville, N.Y., used in accordance with Tag and Label Manufacturers' Institute specifications.

Preferably, the adhesive 24 on label 21 does not cover the whole surface of the label, but rather is present in the form of at least two distinct strips, separated by an adhesive-free strip 25, and also bearing an adhesive-free edge 26, 27 at both ends of the label. This further facilitates easy removal of the label 21 after check-in.

It will be understood that this invention is not limited in its application to video tape cassettes, but may be used in many other applications where articles are alternately removed from and returned to protected premises.

For example, library books lend themselves well to treatment in accordance with the invention. In that case, a resonant circuit-bearing tag 14 may be attached to the fly-leaf of the book, and a foil-bearing label then placed on top of it when the book is checked out, and peeled off when it is returned.

Different legends may be useful for different situations. For example, for library books, the legend "Date Due" may appear on the tag 14, above a blank space to be occupied by the label 21. On the label 21, the date on which return of the book is required may then be stamped at the time the book is checked out and the label is applied.

It should be noted that label 21 is of such simple construction, and therefore inherently so inexpensive to manufacture, that even one-time use is not normally economically prohibitive.

Many other variations will occur to those skilled in the art without departing from the present inventive concept. For example, the resonant circuit-bearing tag, itself, need not be adhesively attached to the protected article, but may be attached in some other way. It is therefore desired that this concept be limited only by the appended claims.

We claim:

1. In combination:

a tag bearing an electronic resonant circuit for use in protecting an article against unauthorized removal from protected premises by causing an alarm in response to such removal, said tag being adapted to be attached to said article, and having when so attached an exposed release liner surface; and a label bearing an electrically conductive layer adapted to disable said tag from causing said alarm when said label is juxtaposed to said tag, said label having an exposed surface, at least a portion of which is adhesive and by which said label can be adhered to said release liner surface of said tag and subsequently separated from said tag surface without damage to said resonant circuit.

2. The combination of claim 1 wherein said tag has an exposed adhesive surface opposite said release liner surface, by which said tag is adapted to be adhesively attached to the protected article.

3. The combination of claim 1 wherein the release liner surface of said tag is provided by a release coating on a paper layer.

4. The combination of claim 1 wherein the release liner surface is provided by a film of polypropylene.

5. The combination of claim 1 wherein said exposed label surface has at least one portion which is non-adhesive.

6. The combination of claim 5 wherein said at least one non-adhesive portion is at the edge of said label.

7. The combination of claim 5 wherein said at least one non-adhesive portion separates plural adhesive portions.

8. The method of protecting returnable articles against unauthorized removal from protected premises which have at their exit apparatus for establishing a radio-frequency field which is swept through a predetermined frequency range and for responding with an alarm to the presence in said field of an electronic circuit which is resonant within said frequency range, said method comprising the steps of:

attaching to a protected article a tag which bears a said resonant circuit, said tag having an exposed release liner surface;

adhesively attaching to said release liner surface, prior to authorized removal of said article from said protected premises, a label bearing a conductive layer which disables said resonant circuit from causing an alarm; and detaching said label from said tag upon return of said article to the protected premises.

9. The method of claim 8 comprising the further steps of:

again adhesively attaching to said release liner surface, prior to authorized removal of said article from said protected premises, a label bearing a conductive layer which disables said resonant circuit from causing an alarm; and again, detaching said label from said tag upon return of said article to the protected premises.

* * * * *